US010450692B2

(12) United States Patent
Wu

(10) Patent No.: US 10,450,692 B2
(45) Date of Patent: Oct. 22, 2019

(54) ADAPTIVE HEAT PUMP CLOTHES DRYER

(71) Applicant: Samsung Electronics, Co. Ltd., Suwon Si, Gyeonggi-Do (KR)

(72) Inventor: Guolian Wu, St. Joseph, MI (US)

(73) Assignee: Samsung Electronics Co., Ltd., Suwon-si (KR)

( * ) Notice: Subject to any disclaimer, the term of this patent is extended or adjusted under 35 U.S.C. 154(b) by 246 days.

(21) Appl. No.: 15/435,161

(22) Filed: Feb. 16, 2017

(65) Prior Publication Data

US 2018/0057997 A1 Mar. 1, 2018

Related U.S. Application Data

(60) Provisional application No. 62/380,906, filed on Aug. 29, 2016.

(51) Int. Cl.

| | |
|---|---|
| ***F26B 7/00*** | (2006.01) |
| ***D06F 58/20*** | (2006.01) |
| ***D06F 58/24*** | (2006.01) |

(52) U.S. Cl.

CPC ..... *D06F 58/206* (2013.01); *D06F 58/24* (2013.01)

(58) Field of Classification Search

CPC ..... D06F 58/26; D06F 58/24

See application file for complete search history.

(56) References Cited

U.S. PATENT DOCUMENTS

| | | | |
|---|---|---|---|
| 8,627,581 | B2 | 1/2014 | Brown |
| 8,650,770 | B1 * | 2/2014 | Levy ..... F26B 21/001 34/219 |
| 9,097,462 | B2 | 8/2015 | Lorenc et al. |
| 9,134,067 | B2 | 9/2015 | Ahn et al. |
| 9,139,948 | B2 | 9/2015 | Wakizaka |
| 9,157,178 | B2 | 10/2015 | Park et al. |
| 9,207,014 | B2 | 12/2015 | Ahn et al. |
| 9,212,450 | B2 | 12/2015 | Grunert et al. |
| 9,238,886 | B2 | 1/2016 | Ryoo et al. |
| 9,285,167 | B2 | 3/2016 | Lee et al. |
| 9,334,601 | B2 | 3/2016 | Doh et al. |
| 9,353,475 | B2 | 5/2016 | Ashrafzadeh et al. |
| 9,359,706 | B2 | 6/2016 | Lundbom |
| 9,372,031 | B2 | 6/2016 | Contarini et al. |
| 9,417,009 | B2 | 8/2016 | Heo et al. |
| 9,422,662 | B2 | 8/2016 | Caldeira et al. |
| 2012/0030960 | A1 | 2/2012 | Ryoo et al. |
| 2012/0137535 | A1 | 6/2012 | Sieben et al. |

(Continued)

FOREIGN PATENT DOCUMENTS

| | | | |
|---|---|---|---|
| EP | 2998432 | A1 | 3/2016 |

*Primary Examiner* — Jason Lau

(57) ABSTRACT

A method and apparatus for an adaptive heat pump clothes dryer is provided. The clothes dryer includes an air flow path, a plurality of sensors, a bypass and a hardware controller. The air flow path is configured to circulate air through the clothes dryer. The sensors are located at multiple points on the air flow path and are configured to detect a plurality of measurements. The bypass is located on the air flow path between an outlet of a drum and an inlet of a heat pump and is configured to divert an amount of the water vapor from the air flow path. The hardware controller is configured to control the amount of water vapor expelled from the air flow path by adjusting the bypass using a partial condensation fraction based on the plurality of measurements.

20 Claims, 6 Drawing Sheets

(56) References Cited

U.S. PATENT DOCUMENTS

| | | | | |
|---|---|---|---|---|
| 2013/0215813 | A1 | 8/2013 | Kotecha et al. | |
| 2015/0343881 | A1* | 12/2015 | Farrington | B60H 1/3233 62/121 |
| 2015/0345866 | A1* | 12/2015 | Yu | F26B 25/005 34/73 |

* cited by examiner

ADAPTIVE HEAT PUMP CLOTHES DRYER

CROSS-REFERENCE TO RELATED APPLICATION AND CLAIM OF PRIORITY

This application claims priority under 35 U.S.C. § 119(e) to U.S. Provisional Patent Application No. 62/380,906 filed on Aug. 29, 2016, titled "ADAPTIVE HEAT PUMP CLOTHES DRYER." The above-identified provisional patent application is hereby incorporated by reference in its entirety.

TECHNICAL FIELD

This disclosure relates generally to a clothes dryer. More specifically, an embodiment relates to a method and apparatus for an adaptive heat pump clothes dryer.

BACKGROUND

Clothes dryers are appliances which utilize electricity to heat air and turn a drum which tumbles clothes. The tumbling action and heated air remove moisture from the clothing. Generally, clothes dryers can be one of the most expensive home appliances to operate, using approximately six percent of a home's total electricity usage. Typical heat pump clothes dryers are vent-less dryers, where all moisture from clothes is condensed and removed from the system as liquids. In such application, the cooling capacity of the heat pump system is sized to match the latent load of the clothes dryer. There is a need to improve the dryer efficiency based on the cooling capacity.

SUMMARY

This disclosure provides a method and apparatus for an adaptive heat pump clothes dryer.

In a first embodiment, an apparatus for an adaptive heat pump clothes dryer is provided. The clothes dryer includes an air flow path, a plurality of sensors, a bypass and a hardware controller. The air flow path is configured to circulate air through the clothes dryer. The sensors are located at multiple points on the air flow path and are configured to detect a plurality of measurements. The bypass is located on the air flow path between an outlet of a drum and an inlet of a heat pump and is configured to divert an amount of the water vapor from the air flow path. The hardware controller is configured to control the amount of water vapor expelled from the air flow path by adjusting the bypass using a partial condensation fraction based on the plurality of measurements.

In a second embodiment, a method is provided for managing an adaptive heat pump clothes dryer is provided. The method includes circulating air through an air flow path of a clothes dryer. The method also includes detecting a plurality of measurements using a plurality of sensors located at multiple points on the air flow path. The method also includes diverting an amount of water vapor from the flow path using a bypass located on the air flow path between an outlet of a drum and an inlet of a heat pump. The method further includes controlling the amount of water vapor expelled from the air flow path by adjusting the bypass using a partial condensation fraction based on the plurality of measurements using a hardware controller.

Other technical features may be readily apparent to one skilled in the art from the following FIGURES, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1 through 10, discussed below, and the an embodiment used to describe the principles of this disclosure in this patent document are by way of illustration only and should not be construed in any way to limit the scope of the disclosure. Those skilled in the art will understand that the principles of this disclosure may be implemented in any suitably arranged wireless communication system.

It has been discovered that typical heat pump dryer designs generally leads to excessive heat generation, thus a less efficient heat pump clothes dryer. This disclosure relates to clothes dryer appliances, particularly a partial condensation heat pump dryer. Aspects involve condensing the exact amount water from the moist air coming from the drying drum to recover the heat needed for clothes drying allowing for improved efficiency.

The nomenclature used in the throughout the Specification includes the following:

A: Temperature difference ratio $COP_c$: Cooling coefficient of performance (COP)

$E_o$: Total electrical energy input, [kJ]

$E_{fan}$: Fan energy consumption, typically, $E_{fan}$=0.150 [kW]×3600 [s]=540 [kJ]

$E_{HP}$: Electrical energy consumption of heat pump [kJ]

EF: Energy factor, defined EF=G/$E_o$, [lbs/kWh]

$EF_{full}$: Energy factor with full condensation [lbs/kWh]

$EF_{max}$: Maximum energy factor at the optimal condensation ratio [lbs/kWh]

$EF_{partial}$: Energy factor with partial [lbs/kWh]

G: Mass of bone-dry clothes. G=8.45 [lbs] in the standard DOE clothes dryer test $h_{fg}$: Heat of evaporation of water, 2257 [kJ/kg]

LTR: Latent heat transfer/total heater transfer in the cold side of heat pump

M: Mass of water that needs to be evaporated from wet clothes. In a standard DOE test, M=0.575*G/2.2=2.208 [kg]

$Q_{loss}$: Heat loss of the dryer to the ambient air through the mechanical structure, [kJ]

$T_0$: Ambient air temperature $T_{cold}$: Average temperature of the cold side of the heat pump $T_{hot}$: Average temperature of the hot side of the heat pump $T_{in}$: Air inlet temperature of the drum $T_{out}$: Air outlet temperature of the drum W: Electrical energy input to heat pump [kJ]

x: partial condensation fraction y: dryer operation parameter set

η: Thermal efficiency, $$\eta = \frac{M \cdot R}{E_O}.$$

It does not account for heat loss with the exhaust air

ξ:

$$\xi = \frac{M_{air}}{M},$$

water to air mass ratio.

$\varphi_{in}$: Air inlet relative humidity of the drum $\varphi_{out}$: Air outlet relative humidity of the drum The numbers used in the previous nomenclature are examples and for reference only.

Figure 1:
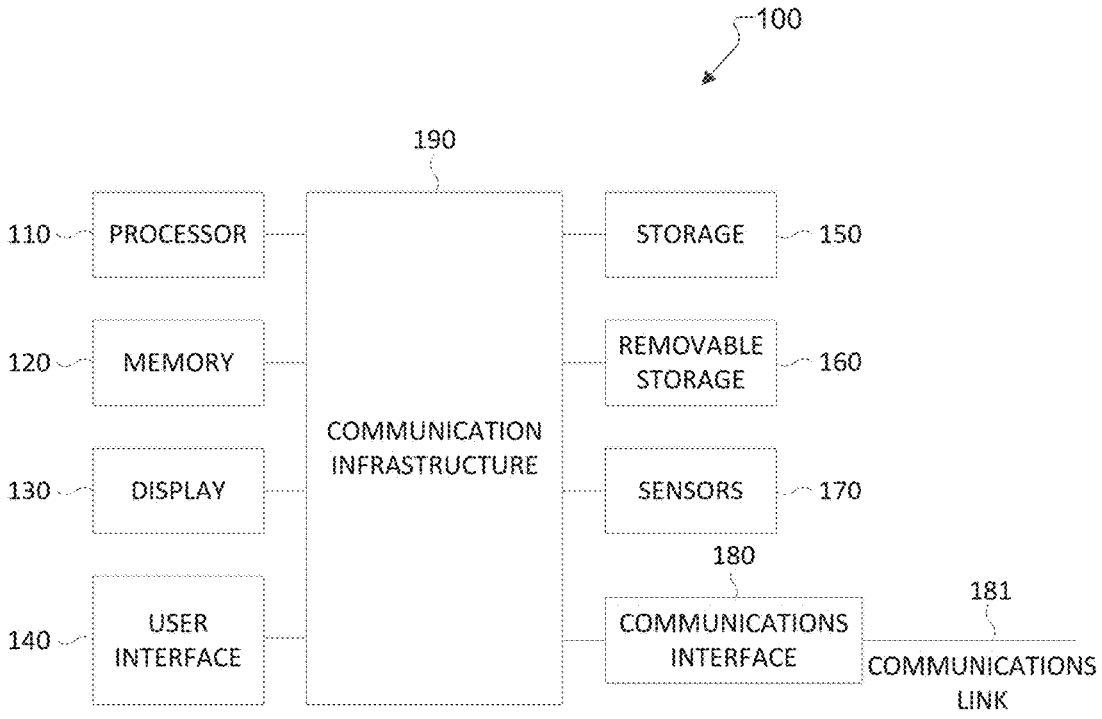
FIG. 1 illustrates an example computer system for an adaptive heat pump clothes dryer according to an embodiment of the present disclosure.

FIG. 1 illustrates an example computer system 100 in an adaptive heat pump clothes dryer according to an embodiment of the present disclosure.

As shown in FIG. 1, the computer system includes one or more processors 110, a main memory 120 (e.g., random access memory (RAM)), an electronic display 130 (for displaying graphics, text, and other data), a user interface 140 (e.g., keyboard, touch screen, keypad, pointing device), a storage 150, a removable storage 160 (e.g., a removable storage drive, a removable memory module, a magnetic tape drive, an optical disk drive, a computer readable medium having stored therein computer software and/or data), one or more sensors 170 (e.g., temperature sensors, humidity sensors, etc.), a communication interface 180 (e.g., modem, a network interface (such as an Ethernet card), a communications port, or a personal computer memory card international association (PCMCIA) slot and card), and a communications infrastructure 190 (e.g., a communication bus, cross-over bar, or network). The communication interface 180 allows software and data to be transferred between the computer system and external devices. The communications infrastructure 190 connects the other devices and modules of the computer system.

Information transferred via the communications interface 180 may be in the form of signals such as electronic, electromagnetic, optical, or other signals capable of being received by the communications interface 180, via a communication link 181 that carries signals and may be implemented using wire or cable, fiber optics, a phone line, a cellular phone link, a radio frequency (RF) link, and/or other communications channels. Computer program instructions representing the block diagram and/or flowcharts herein may be loaded onto the computer system 100, programmable data processing apparatus, or processing devices to cause a series of operations performed thereon to produce a computer implemented process.

The communication interface 180 may receive an incoming RF signal such as a BLUETOOTH signal or a Wi-Fi signal. The communication interface 180 may down-convert an incoming RF signal to generate an intermediate frequency (IF) or baseband signal. The IF or baseband signal is sent to communication interface 180, which generates a processed baseband signal by filtering, decoding, and/or digitizing the baseband or IF signal. The communication interface 180 transmits the processed baseband signal to the processor 110 for further processing.

The user interface 140 receives analog or digital voice data from a microphone or other outgoing baseband data from the processor 110. The communications interface 180 encodes, multiplexes, and/or digitizes the outgoing baseband data to generate a processed baseband or IF signal. The communication interface 180 may receive the outgoing processed baseband or IF signal from the communications interface 180 and up-converts the baseband or IF signal to an RF signal that is transmitted.

The processor 110 can include one or more processors and execute an operating system (OS) program stored in the storage 150 in order to control the overall operation of the computer system 100. For example, the processor 110 may control the reception of forward channel signals and the transmission of reverse channel signals by the communication interface 180, the communication infrastructure 190, and the communications link 181 in accordance with well-known principles. In some embodiments, the processor 110 includes at least one microprocessor or microcontroller.

The processor 110 is also capable of executing other processes and programs resident in the memory 120. The processor 110 can move data into or out of the memory 120 as required by an executing process. In some embodiments, the processor 110 is configured to execute applications based on the OS program or in response to signals received from external devices or an operator. The processor 110 can execute an application for operating the adaptive heat pump clothes dryer.

The processor 110 is also coupled to the user interface 140. The operator of the computer system 100 can use the user interface 140 (e.g., keypad, touchscreen, button etc.) to enter data into the computer system 100.

The processor is also couple to the display 130. The display 130 may be a liquid crystal display, a light-emitting diode (LED) display, an optical LED (OLED), an active matrix OLED (AMOLED), or other display capable of rendering text and/or at least limited graphics, such as from web sites.

The memory 120 is coupled to the processor 110. Part of the memory 260 may include a random access memory (RAM), and another part of the memory 260 may include a flash memory or other read-only memory (ROM).

Computer system 100 further includes one or more sensors 170 that can meter a physical quantity or detect an activation state of the computer system 100 and convert metered or detected information into an electrical signal. For example, sensor 170 may include one or more buttons for touch input, a camera, a gesture sensor, a gyroscope or gyro sensor, an air pressure sensor, a magnetic sensor or magnetometer, an acceleration sensor or accelerometer, a grip sensor, a proximity sensor, a color sensor (e.g., a red green blue (RGB) sensor), a bio-physical sensor, a temperature sensor, a humidity sensor, an illumination sensor, an ultraviolet (UV) sensor, an electromyography (EMG) sensor, an electroencephalogram (EEG) sensor, an electrocardiogram (ECG) sensor, an IR sensor, an ultrasound sensor, an iris sensor, a fingerprint sensor, etc. The sensor(s) 170 can further include a control circuit for controlling at least one of the sensors included therein. Any of these sensor(s) 170 may be located within the computer system 100, outside the computer system 100 within an adaptive heat pump clothes dryer, or in both the adaptive heat pump clothes dryer and computer system 100.

As described in more detail below, when the computer system 100 is operating an adaptive heat pump clothes dryer, the computer system 100 detects a plurality of temperature and humidity values at various locations in the heat pump clothes dryer and uses the detected temperature and humidity values to determine an amount of water vapor to vent.

Although FIG. 1 illustrates an example of a computer system 100 in an adaptive heat pump clothes dryer, various changes may be made to FIG. 1. For example, various components in FIG. 1 may be combined, further subdivided, or omitted and additional components may be added according to particular needs. As a particular example, the processor 110 may be divided into multiple processors, such as one or more central processing units (CPUs).

Figure 2:
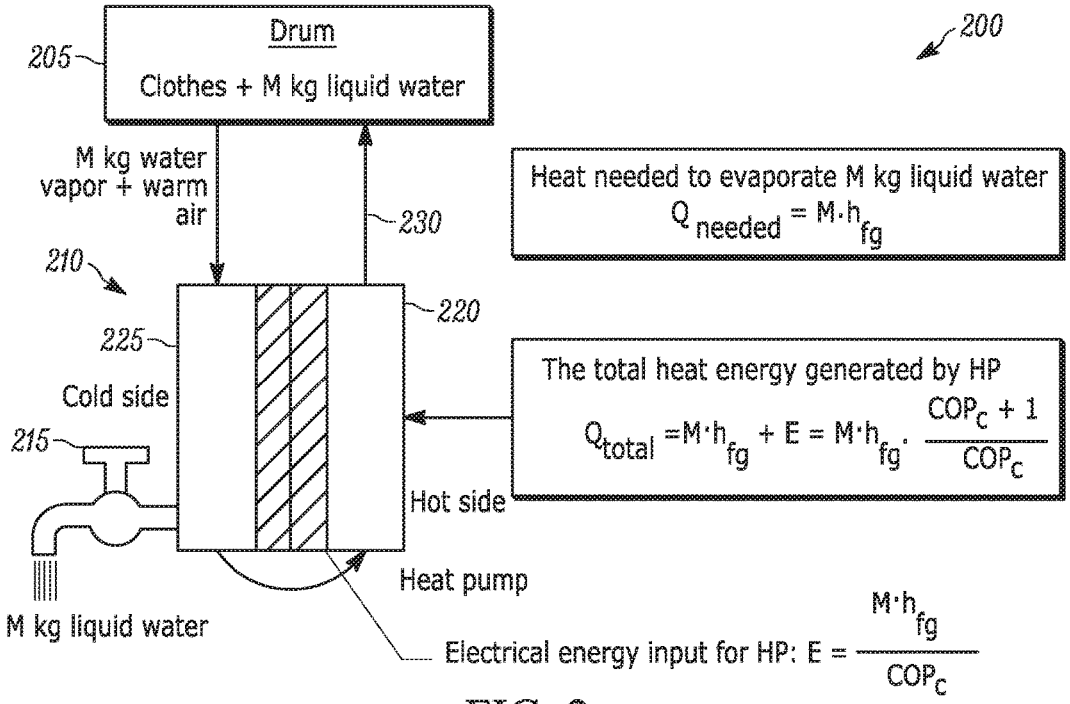
FIG. 2 illustrates an example of a full condensation heat pump clothes dryer according to an embodiment of the present disclosure.

FIG. 2 illustrates an example of a full condensation heat pump clothes dryer 200 according to an embodiment of the present disclosure. The embodiment of the full condensation heat pump clothes dryer 200 shown in FIG. 2 is for illustration only. Other embodiments of the full condensation heat pump clothes dryer 200 may be used without departing from the scope of this disclosure. The full condensation heat pump clothes dryer 200 can be control by a computer system 100 illustrated in FIG. 1.

The clothes dryer 200 includes a drum 205 and a heat pump 210. The heat pump includes a water extract 215, a hot side 220 and a cold side 225. When power is input to the heat pump 200, the energy is used to heat air on the hot side 220 and condense water vapor on the cold side 225. The condensed water is then extracted from the heat pump 210 through the water extract 215. the clothes dryer 200 also includes an air flow path 230 that directs the air through the clothes dryer 200. The air flow path 230 directs the air through the hot side 220 of the heat pump 210, the drum 205, and the cold side 225 of the heat pump 210.

Consider a drying drum 205 containing clothes with M [kg] water, as shown in FIG. 2. In an ideal case, i.e. an adiabatic system, the heat needed to evaporate the water is defined by $Q_{needed}=M\cdot h_{fg}$, where $h_{fg}$ is the evaporation heat in [kJ/kg].

In a full condensation heat pump clothes dryer 200, M kg of water is evaporated in order to clear the drying drum 205 and is condensed back to liquid water on the cold side 225 of a heat pump 210. The electrical energy consumption of heat pump 210 can be defined by the following equation (1):

$$E = \frac{M \cdot h_{fg}}{COP_C} \tag{1}$$

where COPc is a cooling coefficient of performance of the heat pump 210.

Once the total amount of energy that the heat pump 210 consumes is known, total amount of heat generated can be determined. The total amount of heat generated can be determined based on the amount of water, the heat of evaporation for water and the electrical energy consumption of the heat pump 210. The total heat generated by the heat pump 210 can be calculated using the following equation (2):

$$Q_{total} = M \cdot h_{fg} + E = M \cdot h_{fg} \cdot \frac{COP_c + 1}{COP_c} \tag{2}$$

Once the total heat generated by the heat pump 210 is known, the amount of heat needed for the extraction of the amount of water can be determined. The amount of heat needed for extraction can be determined based on the amount of water for extraction and the heat of evaporation for water. The heat needed for extraction of the amount of water can be determined by the following equation (3):

$$Q_{needed}=M\cdot h_{fg} \tag{3}$$

Because the total amount of heat generated is greater than the amount of heat needed to evaporate the water, a loss of heat is experience by the clothes dryer 200. The loss of heat may be defined by the following equation (4):

$$Q_{loss}=Q_{total}-Q_{needed}=E=\frac{M\cdot h_{fg}}{COP_c} \tag{4}$$

An energy factor can be determined for the clothes dryer 200 based on the mass of the clothes in pounds (G) and the energy consumption in kWh. The energy factor can be defined by the department of energy by a standard test according to the following equation (5):

$$EF=\frac{G}{E_O} \tag{5}$$

In the standard department of energy test, the generic amount of water in clothes used for testing purposes is 57.5% of the dry clothes mass. Substituting the mass in the energy factor equation (5) provides the following equation (6) for generic testing purposes:

$$E_{full}=\frac{G}{E_O}=\frac{\frac{2.2M}{.575}}{\frac{E}{3600}}=\frac{13773.9\cdot COP_c}{h_{fg}}=6.103\cdot COP_c \tag{6}$$

Although FIG. 2 illustrates one example of a full condensation heat pump clothes dryer 200, various changes may be made to FIG. 2. For example, various components in FIG. 2 may be combined, further subdivided, or omitted and additional components may be added according to particular needs.

Figure 3:
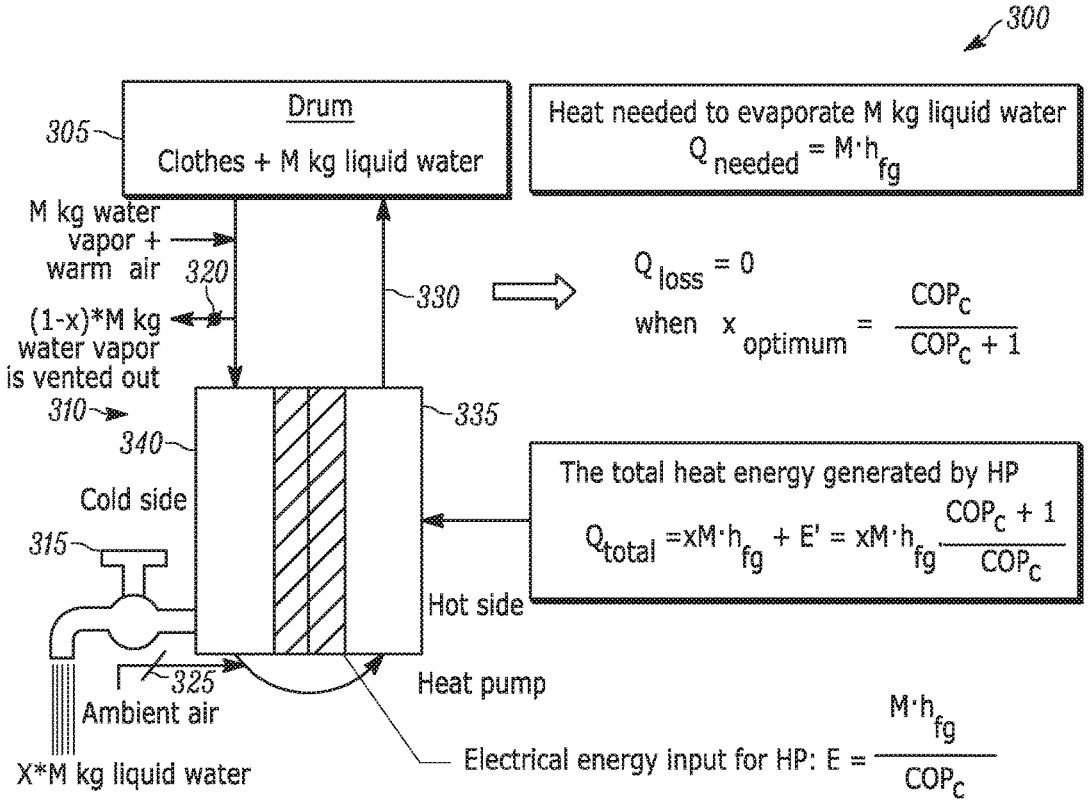
FIG. 3 illustrates an example of a partial condensation heat pump clothes dryer according to an embodiment of the present disclosure.

FIG. 3 illustrates an example of a partial condensation heat pump clothes dryer 300 according to an embodiment of the present disclosure. The embodiment of the partial condensation heat pump clothes dryer 300 shown in FIG. 3 is for illustration only. Other embodiments of the partial condensation heat pump clothes dryer 300 may be used without departing from the scope of this disclosure. The partial condensation heat pump clothes dryer 300 can be control by a computer system 100 illustrated in FIG. 1.

FIG. 3 illustrates an exemplary embodiment of a partial condensation heat pump clothes dryers 300 that includes a drum 305, a heat pump 310, and an air flow path 330. The air flow path 330 directs the air through the cold side 340 of the heat pump 310, hot side 335 of the heat pump 310 and drum 305. The air flow path 330 includes a bypass 320 between the drum 305 and the cold side 340 of the heat pump 310. The air flows through the hot side 335 of the heat pump 310 can be heated before entering the drum 305. The heated air in the drum 305 evaporates the water in the clothes and water vapor is directed out of the air flow path 330. The flow of air can be directed through the air flow path 330, for example, by use of a fan, turbine, convection, etc.

The bypass 320 can be used to divert an amount of water vapor from the drum 305. The amount of air diverted by the bypass 320 can be constant or variable. For example, the clothes dryer 300 can include a number of sensors at multiple points that can be used to determine an amount of water in the air exiting the drum 305 and the bypass 320 can be adjusted based on the amount of water.

A fraction (x) of the water vapor, which is not diverted by the bypass 320, is condensed and the corresponding heat is recovered at the cold side of the heat pump 310 and the remaining portion (1−x) of the water vapor is exhausted to the ambient surrounding by a bypass 320. An equal amount of ambient air is added to the air flow path 330 between the cold side 340 of the heat pump 310 and the hot side 335 of the heat pump 310.

The reduction of the water vapor sent through the cold side of the heat pump reduces the amount of electric energy consumption required by the heat pump. The electric energy consumption by the heat pump 310 may be determined by the following equation (7):

$$E=\frac{x\cdot M\cdot h_{fg}}{COP_c} \tag{7}$$

The reduction in the water vapor reduces the total amount of water needed to be heated by the heat pump. The total heat generated by the heat pump 310 may be determined by the following equation (8):

$$Q_{total}=xM\cdot h_{fg}+E=xM\cdot h_{fg}\cdot\frac{COP_c+1}{COP_c} \tag{8}$$

Although a reduction of water vapor in the cold side of the heat pump, the ambient air is also required to be heated on the hot side of the heat pump. The heat needed for evaporating the water in the drum and for making up the difference in temperature between the air in the air flow path and the ambient air temperature can be determined by the following equation (9):

$$Q_{needed}=M\cdot h_{fg}+(1-x)\cdot\xi\cdot M\cdot C_p\cdot(T_{out}-T_O) \tag{9}$$

A water to air mass ratio may be given by the following equation (10):

$$\xi=\frac{M_{air}}{M}=\frac{h_{fg}}{c_p(T_{in}-T_{out})} \tag{10}$$

The energy factor of a partial condensation pump 300 is maximized when $Q_{needed}=Q_{total}$. The optimal factor of partial condensation (x) can be obtained by the following equation (11):

$$x_{opt}=\frac{1+A}{\frac{COP_c+1}{COP_c}+A} \tag{11}$$

where $$A=\frac{T_{out}-T_0}{T_{in}-T_{out}}$$

The energy factor of a partial condensation heat pump dryer 300 may be determined by the following equation (13):

$$EF_{partial} = \frac{G}{E} = \frac{13773.9 \cdot COP_c}{x \cdot h_{fg}} = \frac{6.103 \cdot COP_c}{x} \tag{13}$$

The energy factor is at its maximum when $x=x_{opt}$, simplifying the previous equation (13) to equation (14):

$$EF_{max} = \frac{6.103 \cdot COP_c}{1+A} \cdot \left(\frac{COP_c+1}{COP_c} + A\right) \tag{14}$$

The energy improvement by partial condensation can be determined by the following equation (15):

$$\frac{EF_{max} - EF_{full}}{EF_{full}} = \frac{1}{(1+A) \cdot COP_c} \tag{15}$$

Partial condensation significantly increases the energy efficiency of a heat pump dryer compared to the full condensation. For example, the energy efficiency improvement by partial condensation is 77% when the heat system has a cooling COP of 1. The improvement is less with an increasing cooling coefficient of performance (COP). A cooling coefficient of performance (COP) can be determined as a function of a temperature of a hot side of the heat pump and a temperature of the cold side of the heat pump. For instance the energy improvement is reduced to 38% if the cooling COP of the heat pump system is 2.

When taking into consideration thermal loss in the drum and sensible cooling in the system, the partial condensation is increasingly effective over full condensation. The energy of the heat pump can be determined by the following equation (16):

$$E_{HP} = \frac{M \cdot h_{fg}}{COP_c \cdot LTR} \tag{16}$$

where LTR is the latent to total heat transfer ratio. The dehumidification is always accompanied by sensible cooling. The latent to total heat transfer ratio represents the percentage of the total cooling used from dehumidification. The total heat of the clothes dryer may be determined by the following equation (17):

$$Q_{total} = M \cdot h_{fg} + E_{HP} = M \cdot h_{fg} \cdot \frac{COP_c \cdot LTR + 1}{COP_c \cdot LTR} \tag{17}$$

The heat need to evaporate the water in the drum is increased due to the thermal efficiency of the drum and can be determined by the following equation (18):

$$Q_{needed} = M \cdot h_{fg}/\eta \tag{18}$$

where $\eta$ is the thermal efficiency of the drum, which measures the percentage of heat provided actually needed for evaporating the water. The oversupply of heat in the system may be then determined by the following equation (19):

$$Q_{loss} = Q_{total} - Q_{needed} = M \cdot h_{fg} \cdot \left(1 + \frac{1}{COP_c \cdot LTR} - \frac{1}{\eta}\right) \tag{19}$$

With the sensible cooling and thermal loss taken into consideration, the energy factor of the clothes dryer can be determined by the following equation (20):

$$EF_{full} = \frac{G \cdot 3600}{E_{HP} + E_{Fan}} = \frac{13773.6 \cdot M \cdot COP_c \cdot LTR}{M \cdot h_{fg} + E_{Fan} \cdot COP_c \cdot LTR} = \frac{6.103}{\frac{1}{COP_c \cdot LTR} + \frac{E_{fan}}{M \cdot h_{fg}}} \tag{20}$$

where $E_{HP}$ and $E_{fan}$ are the electrical energy consumptions of the heat pump and the fan. When a fraction x of the amount of water M is extracted by the heat pump system, the electrical energy of the heat pump may be determined by the following equation (21):

$$E_{HP} = \frac{x \cdot M \cdot h_{fg}}{COP_c \cdot LTR} \tag{21}$$

Based on the energy consumption of the heat pump, the total heat generated by the heat pump can be determined by the following equation (22):

$$Q_{total} = xM \cdot h_{fg} + E_{HP} = xM \cdot h_{fg} \cdot \frac{COP_c \cdot LTR + 1}{COP_c \cdot LTR} \tag{22}$$

Now that the heat energy is not only needed for evaporating the water, but also for heating the ambient air added. The needed amount of heat can be determined by the following equation (23):

$$Q_{needed} = M \cdot h_{fg}/\eta + (1-x) \cdot M \cdot h_{fg} \cdot \frac{T_{out} - T_0}{T_{in} - T_{out}} \tag{23}$$

Because the optimal energy efficiency is achieved when $Q_{total}=Q_{needed}$, the optimum fraction for partial exhaust of the water vapor may be determined by the following equation (24):

$$x_{opt} = \frac{\frac{1}{\eta} + A}{\frac{COP_c \cdot LTR + 1}{COP_c \cdot LTR} + A} \tag{24}$$

Although FIG. 3 illustrates one example of partial condensation heat pump clothes dryer 300, various changes may be made to FIG. 3. For example, various components in FIG. 3 may be combined, further subdivided, or omitted and additional components may be added according to particular needs.

Figure 4:
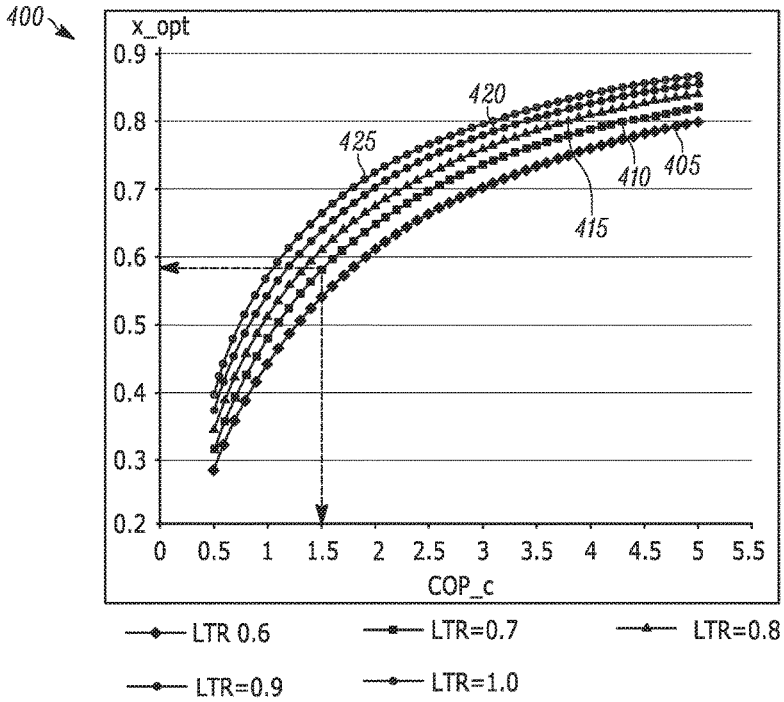
FIG. 4 illustrates an example of a graph for optimal heat recovery vs. cooling coefficient of performance according to an embodiment of the present disclosure.

FIG. 4 illustrates an example of a graph 400 for optimal heat recovery vs. cooling coefficient of performance according to an embodiment of the present disclosure. The embodiment of the graph 400 for optimal heat recovery vs. cooling coefficient of performance shown in FIG. 4 is for illustration only. Other embodiments of the graph 400 for optimal heat recovery vs. cooling coefficient of performance may be used without departing from the scope of this disclosure.

The graph 400 shows the relationship between the optimal condensation fraction and the cooling COP of the heat pump system. Line 405 represents the relationship when the thermal efficiency ($\eta$) is 0.6. Line 410 represents a thermal efficiency of 0.7, Line 415 represents a thermal efficiency of 0.8. Line 420 represents a thermal efficiency of 0.9. Line 425 represents a thermal efficiency of 1.0. Graph 400 illustrates that a greater thermal efficiency allows for a smaller amount of water vapor ($x_{opt}$) to be diverted.

If $COP_C$=1.5, η=0.7, and LTR=0.7, the optimal condensation fraction (x) is 0.73. The energy factor of a dryer under the optimal condensation fraction can be determined by the following equation (26):

$$EF_{partial} = \frac{G \cdot 3600}{E_{HP} + E_{Fan}} = \frac{6.103}{x \cdot \frac{1}{COP_c \cdot LTR} + \frac{E_{fan}}{M \cdot h_{fg}}}_{partial} \quad (26)$$

At the optimal condition, $x=x_{opt}$, then the energy factor can be determined by the following equation (27):

$$EF_{max} = \frac{G \cdot 3600}{E_{HP} + E_{Fan}} = \frac{6.103}{\frac{\frac{1}{\eta} + A}{1 + (1 + A) \cdot COP_c \cdot LTR} + \frac{E_{fan}}{M \cdot h_{fg}}} \quad (27)$$

Although FIG. 4 illustrates one example of graph 400 for optimal heat recovery vs. cooling coefficient of performance, various changes may be made to FIG. 4. For example, various components in FIG. 4 may be combined, further subdivided, or omitted and additional components may be added according to particular needs.

Figure 5:
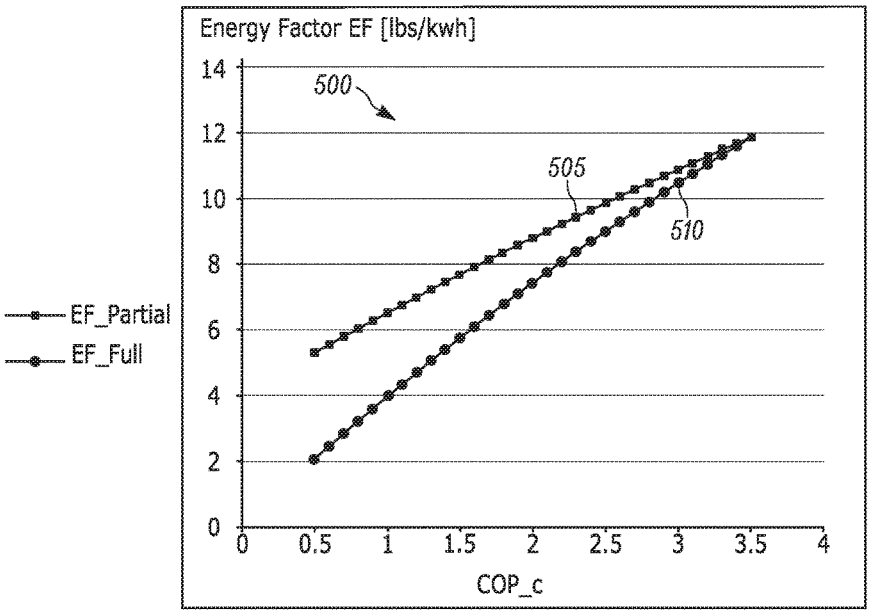
FIG. 5 illustrates an example of a graph for an energy factor comparison between 100% heat recovery and partial heat recovery according to an embodiment of the present disclosure.

FIG. 5 illustrates an example of a graph 500 for an energy factor comparison between 100% heat recovery and partial heat recovery according to an embodiment of the present disclosure. The embodiment of the graph 500 for an energy factor comparison between 100% heat recovery and partial heat recovery shown in FIG. 5 is for illustration only. Other embodiments of the graph 500 for an energy factor comparison between 100% heat recovery and partial heat recovery may be used without departing from the scope of this disclosure.

Graph 500 shows the relationship between the energy factor and the cooling COP of the heat pump system for partial condensation 505 and full condensation 510. The partial condensation 505 has a better energy factor than the full condensation 510 across the cooling COP.

Although FIG. 5 illustrates one example of graph 500 for an energy factor comparison between 100% heat recovery and partial heat recovery, various changes may be made to FIG. 5. For example, various components in FIG. 5 may be combined, further subdivided, or omitted and additional components may be added according to particular needs.

Figure 6:
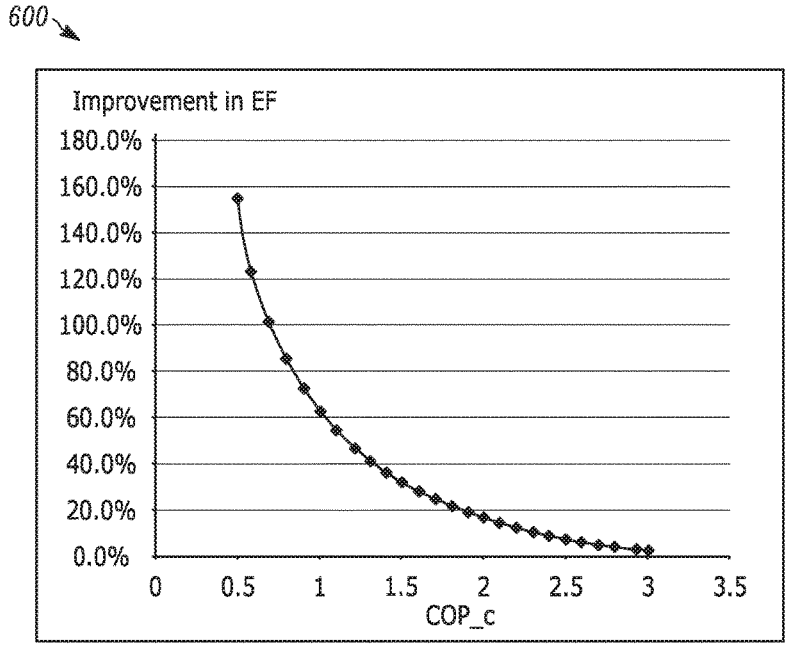
FIG. 6 illustrates an example of a graph for energy improvement of optimal heat recovery vs. cooling coefficient of performance according to an embodiment of the present disclosure.

FIG. 6 illustrates an example of a graph 600 for energy improvement of optimal heat recovery vs. cooling coefficient of performance according to an embodiment of the present disclosure. The embodiment of the graph 600 for energy improvement of optimal heat recovery vs. cooling coefficient of performance shown in FIG. 6 is for illustration only. Other embodiments of the example graph 600 for energy improvement of optimal heat recovery vs. cooling coefficient of performance may be used without departing from the scope of this disclosure.

Graph 600 shows the relationship between the improvement in the energy factor when the cooling COP is adjusted. The heat pump system exhibits a greater improvement in the energy factor at a lower cooling COP.

Although FIG. 6 illustrate one example of an example graph 600 for energy improvement of optimal heat recovery vs. cooling coefficient of performance, various changes may be made to FIG. 6. For example, various components in FIG. 6 may be combined, further subdivided, or omitted and additional components may be added according to particular needs.

Figure 7:
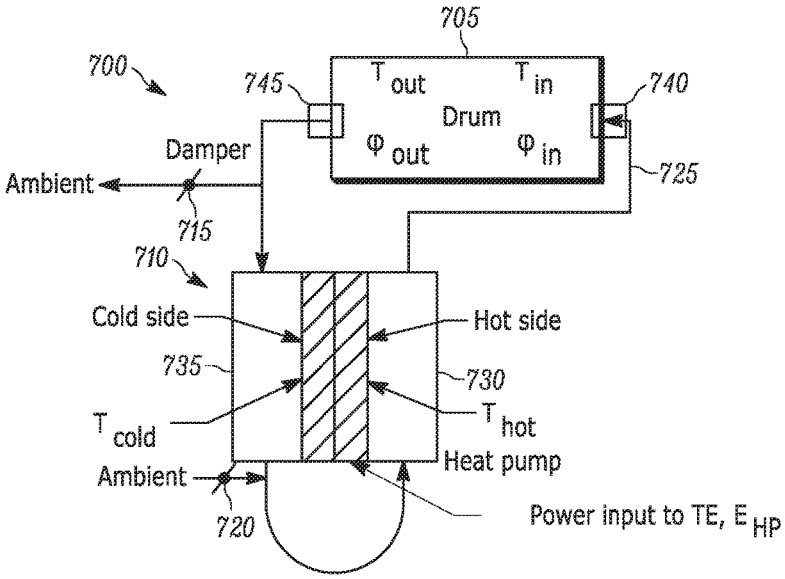
FIG. 7 illustrates example of operation parameters for a heat pump dryer according to an embodiment of the present disclosure.

FIG. 7 illustrates example of operation parameters for a clothes dryer 700 according to an embodiment of the present disclosure. The embodiment of the clothes dryer 700 for a heat pump dryer shown in FIG. 7 is for illustration only. Other embodiments of clothes dryer 700 for a heat pump dryer may be used without departing from the scope of this disclosure.

The partial condensation heat pump clothes dryer 700 includes a drum 705, a heat pump 710, an air flow path 725, and a plurality of sensors 740 and 745 in multiple locations of the clothes dryer 700. The air flow path 725 directs the air through the cold side 735 of the heat pump 710, hot side 730 of the heat pump 710 and drum 705. The air flow path 725 includes a bypass 715 between the drum 705 and the cold side 735 of the heat pump 710. The air that flows through the hot side 730 of the heat pump 710 is heated before entering the drum 705. Sensors 740 are located at the inlet of the drum. The sensors 740 include a humidity sensor and a temperature sensor to take measurements of the humidity and temperature of the heated air entering the drum 705. The heated air in the drum 705 evaporates the water in the clothes and water vapor is exited out of the air flow path 725. Sensors 745 include a humidity sensor and a temperature sensor to take measurements of the humidity and temperature of the water vapor exiting the drum 705.

The bypass 715 is used to divert an amount of water vapor from the drum 705. The amount of air diverted by the bypass 715 can be constant or variable. For example, the clothes dryer 700 can include a number of sensors at multiple points that can be used to determine an amount of water in the air exiting the drum 705 and the bypass 715 can be adjusted based on the amount of water.

A fraction (x) of the water vapor, which is not diverted by the bypass 715, is condensed and the corresponding heat can be recovered at the cold side of the heat pump 710 and the remaining portion (1−x) of the water vapor can be exhausted to the ambient surrounding by a bypass 715. An equal amount of ambient air can be added to the air flow path 725 between the cold side 735 of the heat pump 710 and the hot side 730 of the heat pump 710.

Although FIG. 7 illustrates one example of operation parameters for a clothes dryer 700, various changes may be made to FIG. 7. For example, various components in FIG. 7 may be combined, further subdivided, or omitted and additional components may be added according to particular needs.

Figure 8:
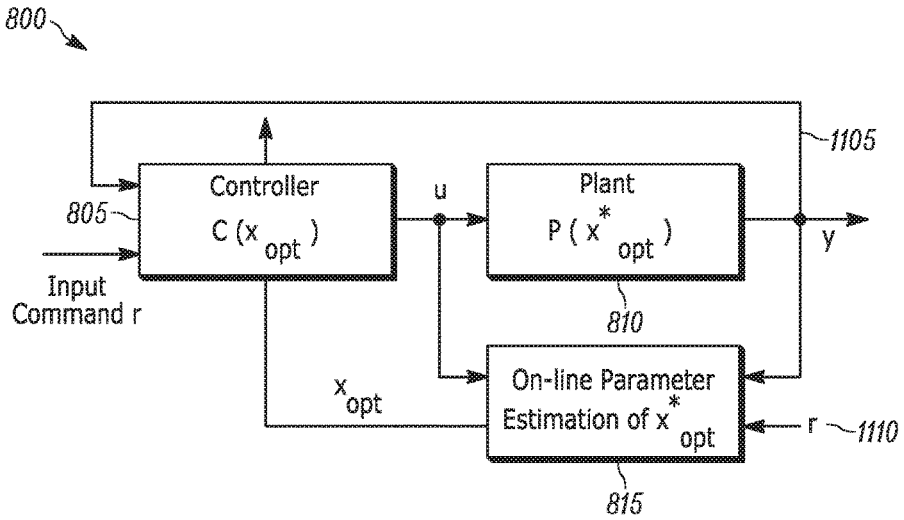
FIG. 8 illustrates an example of a close-loop adaptive control for a partial-condensation heat pump dryer according to an embodiment of the present disclosure.

FIG. 8 illustrates an example of a close-loop adaptive control 800 for a partial-condensation heat pump dryer according to an embodiment of the present disclosure. The embodiment of the close-loop adaptive control 800 shown in FIG. 8 is for illustration only. Other embodiments of the close-loop adaptive control 800 may be used without departing from the scope of this disclosure. The close-loop adaptive control 800 can be used with the clothes dryer 700 of FIG. 7.

The close-loop adaptive control 800 is used for the variable venting of the clothes dryer 700. The close-loop adaptive control 800 includes a controller 805, a plant 810 and on-line parameter estimation circuitry 815. The plant 810 includes the drum 705, the bypass 715, the heat pump 710, the sensors 740 and 745, and any other components of the clothes dryer 700. The sensors 740 and 745 detect various parameters including humidity, temperature, voltage, current, etc. and provide the information (y) to the controller 805. The controller 805 receives input and feedback commands (r) to adjust aspects of the plant 810 or for updating the parameter estimation of $x_{opt}$. The on-line parameter estimation circuitry 815 is also referred to as real-time parameter estimation circuitry, which recalculates $x_{opt}$ based on the time, as described below. The parameter estimation circuitry 815 and the controller 805 can be carried out by a processor using software or be dedicated hardware for performing such functions. The output of the controller 805 can be $x_{opt}$, voltage or power to the heat pump 710, which can vary if the heat pump 710 is a thermoelectric heat pump, total air circulation, an amount of water vapor to be vented from the clothes dryer 700, etc.

As the water is gradually removed from the wet clothes in the drum 705, the amount of water in the water vapor decreases. Thus, the optimal fraction changes over time, which may be determined based on the following equation (28):

$$x_{opt}(t) = \frac{\frac{1}{\eta} + A}{\frac{COP_c \cdot LTR + 1}{COP_c \cdot LTR} + A} \tag{28}$$

In order to achieve the maximum energy efficiency for clothes drying, the close-loop adaptive control 800 adjusts the parameter $x_{opt}$ over time. Specific functions in the parameter estimation circuitry 815 simplifies the determination of $x_{opt}$ based on the three following equations (29, 30, 31):

$$COP_c = f(T_{cold}, T_{hot}) \tag{29}$$

$$LTR = g(T_{in}, \varphi_{in}, T_{out}, \varphi_{out}) \tag{30}$$

$$\eta = u(T_{in}, \varphi_{in}, T_{out}, \varphi_{out}, E_{HP}) \tag{31}$$

Based on the relationships in the preceding three equations, $x_{opt}$ is estimated from measurements of $T_{cold}$, $T_{hot}$, $T_{in}$, $\varphi_{in}$, $T_{out}$, $\varphi_{out}$, $E_{hp}$. The estimation of $x_{opt}$ does not require all the measurements and may be determined with only a subset of the measurements or with additional parameters. An example for an output parameter set (y) of the plant 810 is $y=:\{T_{in}, \varphi_{in}, T_{out}, \varphi_{out}, T_{cold}, T_{hot}, \text{etc} \ldots\}$. An example of a input set (u) of the plant 810 is $u=\{x_{opt}, V, CFM, \text{etc} \ldots\}$.

Although FIG. 8 illustrates one example of a close-loop adaptive control 800, various changes may be made to FIG. 8. For example, various components in FIG. 8 may be combined, further subdivided, or omitted and additional components may be added according to particular needs.

Figure 9:
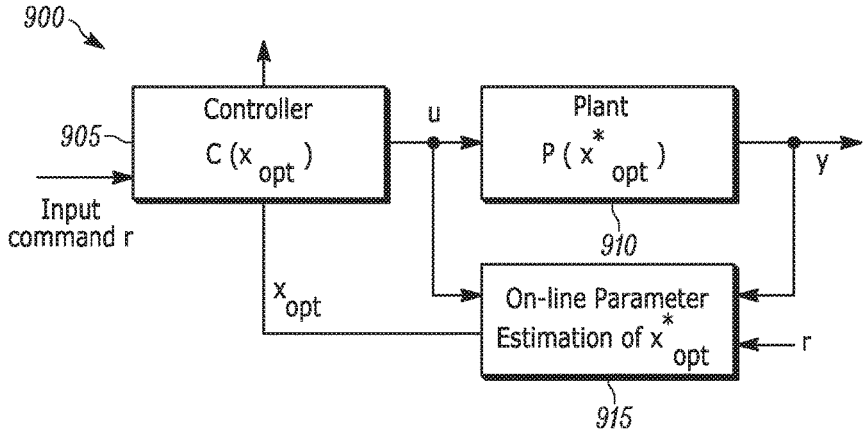
FIG. 9 illustrates an example of an open-loop adaptive control for a partial-condensation heat pump according to an embodiment of the present disclosure.

FIG. 9 illustrates an example of an open-loop adaptive control 900 for a partial-condensation heat pump according to an embodiment of the present disclosure. The embodiment of the open-loop adaptive control 900 shown in FIG. 9 is for illustration only. Other embodiments of the open-loop adaptive control 900 may be used without departing from the scope of this disclosure. The open-loop adaptive control 900 can be used with the clothes dryer 700 of FIG. 7.

The open-loop adaptive control 900 is used for the variable venting of the clothes dryer 700. The open-loop adaptive control 900 includes a controller 905, a plant 910 and on-line parameter estimation circuitry 915. The plant 910 includes the drum 705, the bypass 715, the heat pump 710, the sensors 740 and 745, and any other components of the clothes dryer 700. The sensors 740 and 745 detect various parameters including humidity, temperature, voltage, current, etc. and provide the information (y) to the parameter estimation circuitry 915. The controller 905 receives input and feedback commands (r) to adjust aspects of the plant 910 or for updating the parameter estimation of $x_{opt}$. The on-line parameter estimation circuitry 915 is also referred to as real-time parameter estimation circuitry, which recalculates $x_{opt}$ based on the time, as described below. The parameter estimation circuitry 915 and the controller 905 can be carried out by a processor using software or be dedicated hardware for performing such functions. The output of the controller 905 can be $x_{opt}$, voltage or power to the heat pump 710, which can vary if the heat pump 710 is a thermoelectric heat pump, total air circulation, an amount of water vapor to be vented from the clothes dryer 700, etc.

Although FIG. 9 illustrates one example of an open-loop adaptive control 900, various changes may be made to FIG. 9. For example, various components in FIG. 9 may be combined, further subdivided, or omitted and additional components may be added according to particular needs.

Figure 10:
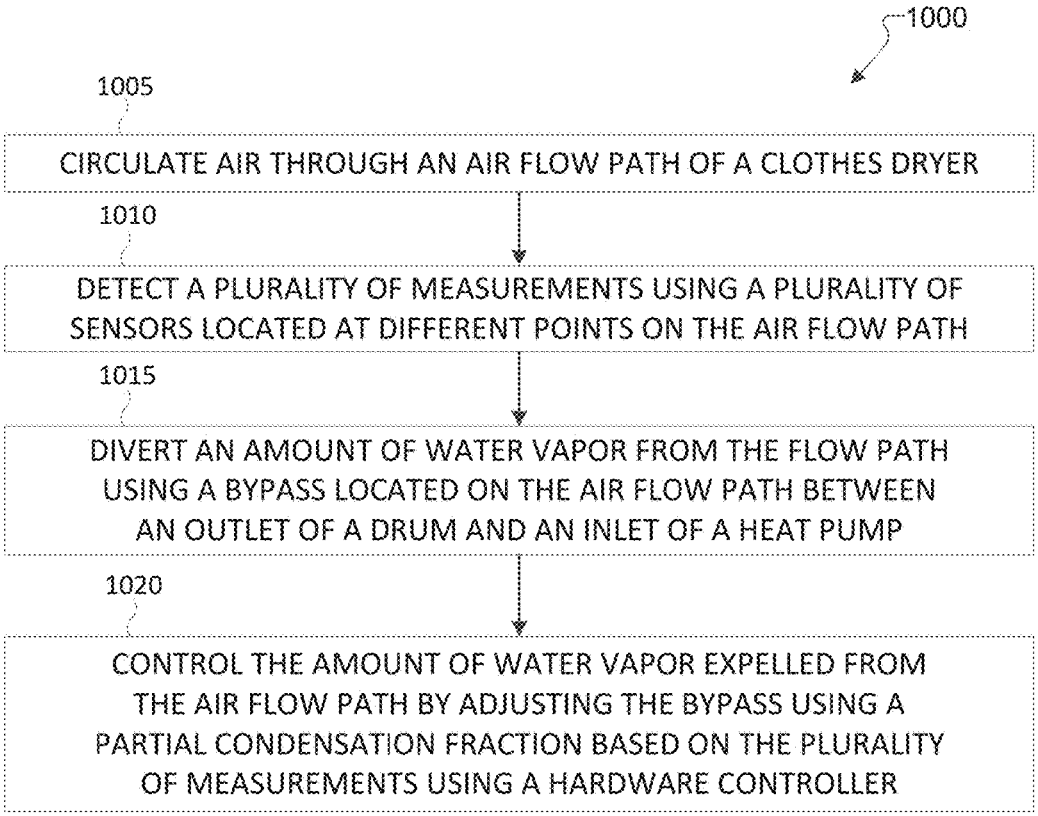
FIG. 10 illustrates an exemplary process for controlling an adaptive heat pump clothes dryer according to an embodiment of the present disclosure.

FIG. 10 illustrates an exemplary process 1000 for controlling an adaptive heat pump clothes dryer according to an embodiment of the present disclosure. For example, the process depicted in FIG. 10 may be performed by computer system 100 in FIG. 1 on the partial condensation heat pump clothes dryer 300 illustrated in FIG. 3.

In operation 1005, the clothes dryer 700 circulates air through an air flow path 725. The air flow path 725 directs the air through a hot side 730 of a heat pump 710, a drum 705, and a cold side 735 of a heat pump 710. The air flow path 725 includes a bypass 715 between an outlet of the drum 705 and an inlet of the cold side 735 of the heat pump 710. The bypass 715 is used to divert a portion of the water vapor exiting the drum 705. The air flow path 725 also includes an ambient air intake 720 between the outlet of the cold side 735 of the heat pump 710 and an inlet of the hot side 730 of the heat pump 710. The ambient air intake 720 replaces the amount of air exhausted by the bypass 715.

In operation 1010, the clothes dryer 700 detects a plurality of measurements using a plurality of sensors 740 and 745 located at multiple points on the air flow path 725. Sensor 740 measures the temperature and humidity of the air entering the drum 705 and sensors 740 measure the temperature and humidity of the water vapor exiting the drum 705. A cooling coefficient of performance (COP) can be determined as a function of a temperature of a hot side of the heat pump and a temperature of the cold side of the heat pump.

In operation 1015, the clothes dryer 700 diverts an amount of water vapor from the air flow path 725 using a bypass 715 located on the air flow path 725 between an outlet of a drum 705 and an inlet of a heat pump 710.

In operation 1020, the clothes dryer 700 controls the amount of water vapor expelled from the air flow path 725 by adjusting the bypass 715 using a partial condensation fraction based on the plurality of measurements using a hardware controller. The partial condensation fraction is determined by parameter estimation circuitry 815. The plurality of measurements used to determine the partial condensation includes, for example, an average temperature of a cold side 735 of a heat pump 710, an average temperature of a hot side 730 of the heat pump 710, a temperature of an air inlet of the drum 705, a humidity of the air inlet of the drum 705, a temperature of an air outlet of the drum 705, a humidity of the air outlet of the drum 705, and an electrical energy consumption of the heat pump 710.

The amount of water vapor diverted by the bypass 715 may be determined by $x_{opt}$ as defined by the following equation (32):

$$x_{opt}(t) = \frac{\frac{1}{\eta} + A}{\frac{COP_c \cdot LTR + 1}{COP_c \cdot LTR} + A} \tag{32}$$

It is a function of cooling COP, thermal efficiency of drum η, and latent to total heat transfer LTR. LTR is defined as a ratio of the amount of water vapor that can be condensed from the water vapor by the heat pump to the total cooling capacity of the heat pump. The LTR is determined as a function of a temperature of an inlet of the drum, a relative humidity of the inlet of the drum, a temperature of an outlet of the drum, and a relative humidity of the outlet of the drum. The bypass 715 diverts the water vapor in excess of the amount of water vapor that is determined to be fully condensed in the heat pump 710.

An amount of energy required to heat the air in the heat pump is determined using an energy for evaporating water in the drum and an energy for heating ambient air replacing the diverted excess water vapor. A thermal efficiency of the drum can also be included when determining the amount of energy require to heat the air in the heat pump. An energy consumption of the heat pump and an energy consumption of a fan can also be included in determining the amount of energy required to heat the air in the heat pump.

Although FIG. 10 illustrates an operation for controlling an adaptive heat pump clothes dryer, various changes may be made to FIG. 10. For example, while shown as a series of steps, various steps may overlap, occur in parallel, occur in a different order, occur multiple times, or not be performed in certain embodiments.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle.

What is claimed is:

1. An adaptive heat pump clothes dryer comprising:
- an air flow path configured to circulate air through the clothes dryer;
- a plurality of sensors located at multiple points on the air flow path and configured to detect a plurality of measurements;
- a bypass located on the air flow path between an outlet of a drum and an inlet of a heat pump and configured to divert an amount of water vapor from the air flow path; and
- a hardware controller configured to:
  - control the amount of water vapor diverted from the air flow path by adjusting the bypass based on a partial condensation fraction determined based on the plurality of measurements,
  - determine, using a humidity sensor, a humidity level of water vapor exiting the drum, and
  - determine an amount of water vapor that can be fully condensed in the heat pump based on the humidity level.

2. The clothes dryer of claim 1, further comprises:
- parameter estimation circuitry configured to determine the partial condensation fraction using the plurality of measurements.

3. The clothes dryer of claim 2, wherein the plurality of measurements used to determine the partial condensation fraction includes at least one of:
- an average temperature of a cold side of the heat pump;
- an average temperature of a hot side of the heat pump;
- a temperature of an air inlet of the drum;
- a humidity of the air inlet of the drum;
- a temperature of an air outlet of the drum;
- a humidity of the air outlet of the drum; and
- an electrical energy consumption of the heat pump.

4. An adaptive heat pump clothes dryer of comprising:
- an air flow path configured to circulate air through the clothes dryer;
- a plurality of sensors located at multiple points on the air flow path and configured to detect a plurality of measurements;
- a bypass located on the air flow path between an outlet of a drum and an inlet of a heat pump and configured to divert an amount of water vapor from the air flow path; and
- a hardware controller configured to:
  - control the amount of water vapor diverted from the air flow path by adjusting the bypass based on a partial condensation fraction determined based on the plurality of measurements, and
  - determine an amount of energy required to heat the air in the heat pump includes based on energy for evaporating water in the drum and energy for heating ambient air replacing the diverted excess water vapor.

5. The clothes dryer of claim 4, wherein to determine the amount of energy required to heat air in the heat pump includes a thermal efficiency of the drum.

6. The clothes dryer of claim 1, wherein to determine the amount of water vapor that can be fully condensed in the heat pump includes a latent to total heat transfer ratio (LTR).

7. The clothes dryer of claim 4, wherein to determine the amount of energy required to heat air in the heat pump includes an energy consumption of the heat pump and an energy consumption of a fan.

8. The clothes dryer of claim 1, wherein the hardware controller is further configured to:
- determine a cooling coefficient of performance (COP) as a function of a temperature of a hot side of the heat pump and a temperature of a cold side of the heat pump.

9. The clothes dryer of claim 6, wherein the hardware controller is further configured to:
- determine the LTR as a function of a temperature of an inlet of the drum, a relative humidity of the inlet of the drum, a temperature of an outlet of the drum, and a relative humidity of the outlet of the drum.

10. A method for managing an adaptive heat pump clothes dryer comprising:
- circulating air through an air flow path of a clothes dryer;
- detecting a plurality of measurements using a plurality of sensors located at multiple points on the air flow path;
- diverting an amount of water vapor from the air flow path using a bypass located on the air flow path between an outlet of a drum and an inlet of a heat pump; and
- controlling, using a hardware controller, the amount of water vapor diverted from the air flow path by adjusting the bypass based on a partial condensation fraction determined based on the plurality of measurements,
- measuring, using a humidity sensor, a humidity level of water vapor exiting the drum, and determining an amount of water vapor that can be fully condensed in the heat pump based on the humidity level.

11. The method of claim 10, further comprising determining, by parameter estimation circuitry, the partial condensation fraction using the plurality of measurements.

12. The method of claim 11, wherein the plurality of measurements used to determine the partial condensation fraction includes at least one of:

an average temperature of a cold side of the heat pump;

an average temperature of a hot side of the heat pump;

a temperature of an air inlet of the drum;

a humidity of the air inlet of the drum;

a temperature of an air outlet of the drum;

a humidity of the air outlet of the drum; and an electrical energy consumption of the heat pump.

13. The method of claim 10, further comprising:

adjusting the bypass to divert excess water vapor based on the determined amount of water vapor that can by fully condensed.

14. The method of claim 13, further comprising determining an amount of energy required to heat the air in the heat pump based on energy for evaporating water in the drum and energy for heating ambient air replacing the diverted water vapor.

15. The method of claim 14, wherein determining the amount of energy required to heat air in the heat pump includes a thermal efficiency of the drum.

16. The method of claim 13, wherein determining the amount of the water vapor that can be fully condensed in the heat pump includes a latent to total heat transfer ratio (LTR).

17. The method of claim 14, wherein determining the amount of energy required to heat air in the heat pump includes an energy consumption of the heat pump and an energy consumption of a fan.

18. The method of claim 13, further comprising:

determining a cooling coefficient of performance (COP) as a function of a temperature of a hot side of the heat pump and a temperature of a cold side of the heat pump.

19. The method of claim 16, further comprising:

determining the LTR as a function of a temperature of an inlet of the drum, a relative humidity of the inlet of the drum, a temperature of an outlet of the drum, and a relative humidity of the outlet of the drum.

20. The clothes dryer of claim 1, wherein the partial condensation fraction is a function of a COP, a thermal efficiency of the drum, and an LTR.

* * * * *